US009035799B2

(12) United States Patent
Love

(10) Patent No.: US 9,035,799 B2
(45) Date of Patent: May 19, 2015

(54) PROVIDING PARKING AVAILABILITY INFORMATION AND PARKING ALERTS

(71) Applicant: Verizon Patent and Licensing Inc., Basking Ridge, NJ (US)

(72) Inventor: David D. Wayne Love, Irving, TX (US)

(73) Assignee: VERIZON PATENT AND LICENSING INC., Basking Ridge, NJ (US)

( * ) Notice: Subject to any disclaimer, the term of this patent is extended or adjusted under 35 U.S.C. 154(b) by 50 days.

(21) Appl. No.: 13/828,275

(22) Filed: Mar. 14, 2013

(65) Prior Publication Data

US 2014/0266802 A1 Sep. 18, 2014

(51) Int. Cl.
*G08G 1/14* (2006.01)
*G08G 1/04* (2006.01)

(52) U.S. Cl.
CPC ..... *G08G 1/146* (2013.01); *G08G 1/04* (2013.01); *G08G 1/144* (2013.01)

(58) Field of Classification Search
CPC ..... G08G 1/14; G08G 1/146; G08G 1/147; G08G 1/148; G06Q 30/0284; G07B 15/02
USPC ..... 340/932.2, 995.12, 425.5, 539.1, 454; 701/423, 454; 455/456.1
See application file for complete search history.

(56) References Cited

U.S. PATENT DOCUMENTS

| | | | | |
|---|---|---|---|---|
| 5,432,508 | A * | 7/1995 | Jackson | 340/932.2 |
| 7,492,283 | B1 * | 2/2009 | Racunas, Jr. | 340/932.2 |
| 8,139,115 | B2 * | 3/2012 | Barnes et al. | 348/149 |
| 8,217,806 | B2 * | 7/2012 | Kim | 340/932.2 |
| 8,665,118 | B1 * | 3/2014 | Woodard et al. | 340/932.2 |
| 2010/0007525 | A1 * | 1/2010 | Shanbhag et al. | 340/932.2 |
| 2012/0098677 | A1 * | 4/2012 | Geelen | 340/932.2 |
| 2012/0135746 | A1 * | 5/2012 | Mohlig et al. | 455/456.1 |

OTHER PUBLICATIONS

Inrix, Inc. "Inrix—Directions and Driver Services", Mar. 14, 2013, 2 pages.
Deteq, "Deteq—Smart Sensors", 1 page, Sep. 17, 2014 (Print Date).
SFPark, SFPark—How it Works, 1 page, Sep. 17, 2014 (Print Date).
Streetline Inc., "Parker" Jul. 15, 2014, 2 pages.

* cited by examiner

*Primary Examiner* — Phung Nguyen

(57) ABSTRACT

A device may receive map data that identifies a parking facility located in a particular geographic area; identify the parking facility based on the map data; receive parking data that identifies an available or an unavailable parking space located in the parking facility; combine the map data and the parking data to form combined data; and provide the combined data for display. The combined data may cause a map of the particular geographic area to be displayed. The map may have a representation of the parking facility, a representation of a number of available or unavailable parking spaces in the parking facility, or a representation of an entrance of the parking facility.

20 Claims, 9 Drawing Sheets

Raw Sensor Data
410

Parking Facility ID: 123
Parking Facility Location: 100 Parking Avenue

| Space ID | Type | Fee | Level | Occupied |
|---|---|---|---|---|
| 100 | Regular | $1/hr | 1 | X |
| 101 | Regular | $1/hr | 1 | X |
| 102 | Regular | $1/hr | 1 | X |
| 103 | Parallel | $2/hr | 1 | |
| 104 | Handicap | $0/hr | 1 | X |
| 105 | Handicap | $0/hr | 1 | |
| ⋮ | | | | |
| 200 | Regular | $1/hr | 2 | X |
| 201 | Regular | $1/hr | 2 | X |
| 202 | Regular | $1/hr | 2 | X |
| 203 | Parallel | $2/hr | 2 | X |
| 204 | Handicap | $0/hr | 2 | X |
| 205 | Handicap | $0/hr | 2 | X |

Summary Data
420

| Level | Regular Avail. | Handicap Avail. | No Fee Avail. | Total Avail. | Total | Percent Avail. |
|---|---|---|---|---|---|---|
| 1 | 1 | 1 | 0 | 2 | 100 | 2.0% |
| 2 | 0 | 0 | 0 | 0 | 100 | 0.0% |
| 3 | 45 | 5 | 10 | 50 | 100 | 50.0% |
| 4 | 22 | 3 | 5 | 25 | 75 | 33.3% |

Raw Sensor Data
410

Parking Facility ID: 123
Parking Facility Location: 100 Parking Avenue

| Space ID | Type | Fee | Level | Occupied |
|---|---|---|---|---|
| 100 | Regular | $1/hr | 1 | X |
| 101 | Regular | $1/hr | 1 | X |
| 102 | Regular | $1/hr | 1 | X |
| 103 | Parallel | $2/hr | 1 | |
| 104 | Handicap | $0/hr | 1 | X |
| 105 | Handicap | $0/hr | 1 | |
| ⋮ | | | | |
| 200 | Regular | $1/hr | 2 | X |
| 201 | Regular | $1/hr | 2 | X |
| 202 | Regular | $1/hr | 2 | X |
| 203 | Parallel | $2/hr | 2 | X |
| 204 | Handicap | $0/hr | 2 | X |
| 205 | Handicap | $0/hr | 2 | X |

Summary Data
420

| Level | Regular Avail. | Handicap Avail. | No Fee Avail. | Total Avail. | Total | Percent Avail. |
|---|---|---|---|---|---|---|
| 1 | 1 | 1 | 0 | 2 | 100 | 2.0% |
| 2 | 0 | 0 | 0 | 0 | 100 | 0.0% |
| 3 | 45 | 5 | 10 | 50 | 100 | 50.0% |
| 4 | 22 | 3 | 5 | 25 | 75 | 33.3% |

Fig. 4

PROVIDING PARKING AVAILABILITY INFORMATION AND PARKING ALERTS

BACKGROUND

Motorists sometimes use parking facilities to park vehicles for a particular period of time. Identifying parking availability in a parking facility is often time consuming, tedious, and sometimes does not result in the motorist finding an available parking space, thereby causing the motorist to find another parking facility which may or may not have available parking.

BRIEF DESCRIPTION OF THE DRAWINGS

FIG. 4 illustrates an example data structure that may be stored by one or more devices in the environment of FIG. 2;

DETAILED DESCRIPTION OF THE PREFERRED EMBODIMENTS

The following detailed description refers to the accompanying drawings. The same reference numbers in different drawings may identify the same or similar elements.

Systems and/or methods, as described herein, may provide information identifying available parking, for example, at parking facilities, such as parking garages, parking lots, or street parking facilities. Further, the systems and/or methods may alert a motorist of an available parking space that meets particular criteria (e.g., an available parking space that is within a particular distance of the motorist and/or landmark, or some other criteria).

Figure 1A:
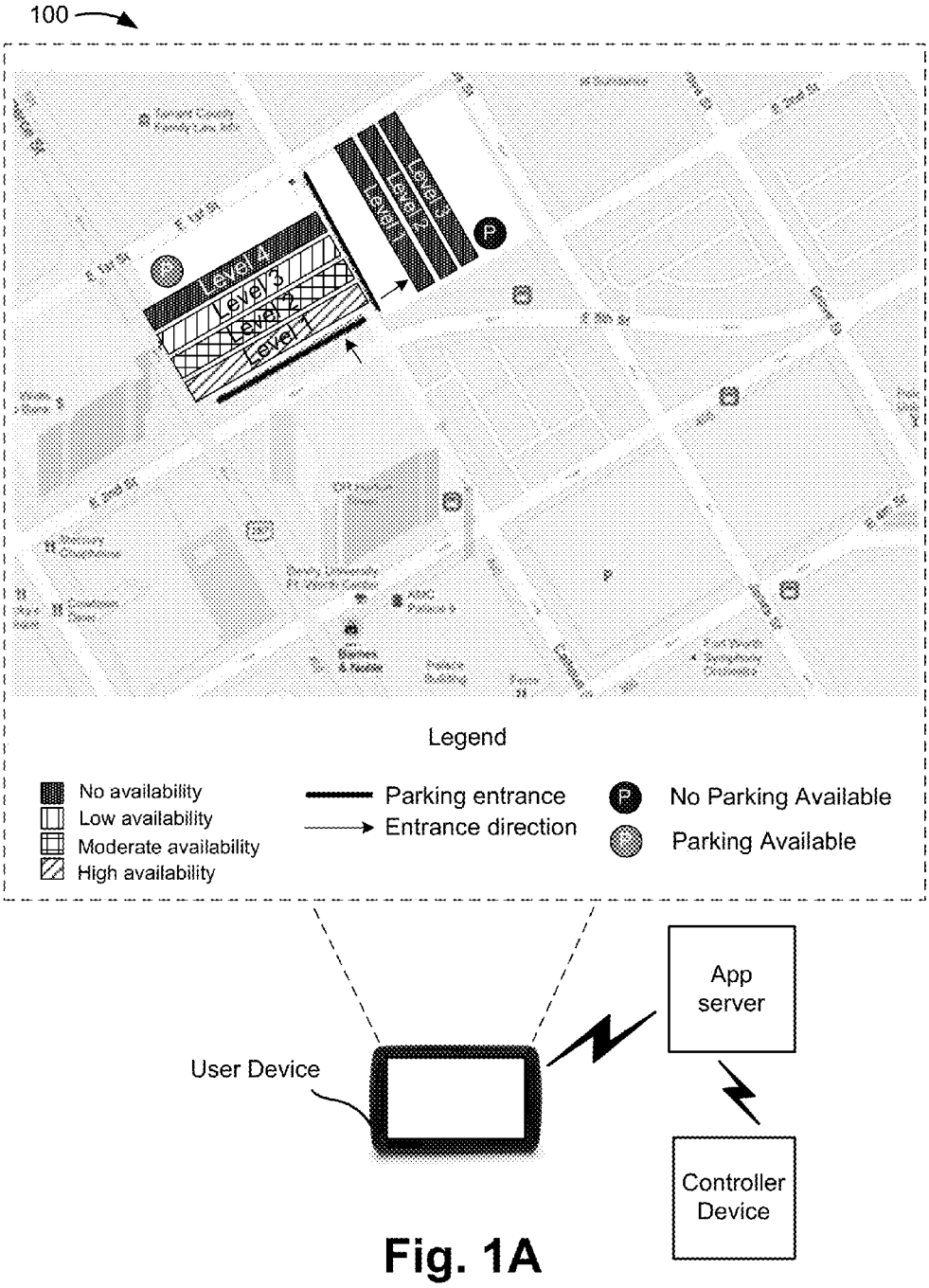
FIGS. 1A-1B illustrate example overviews of implementations described herein.

FIG. 1A illustrates an example overview of an implementation described herein. As shown in FIG. 1A, a user device (e.g., a smart phone, a tablet computing device, a navigation system, etc.) may communicate with an application ("app") server to display a map identifying one or more parking facilities and to identify parking availability information associated with the one or more parking facilities. For example, the app server may communicate with a controller device to receive the parking availability information. In some implementations, the app server may overlay the parking availability information on the map. In some implementations, the user device may display the map via a user interface, such as interface 100. As shown in interface 100, a parking facility may be identified on the map by an indication, such as an icon having the letter "P."

As further shown in interface 100, the map may identify a geographic location of the parking facility, a layout of the parking facility (e.g., an entrance location of the parking facility, a blueprint, a number of levels in the parking facility, etc.), and/or a measure of available parking per level in the parking facility. For example, the measure of available parking may include a particular number of available parking spaces and/or a pattern or color that identifies a measure of parking availability, such as "no availability," "low availability," "moderate availability," "high availability," etc. In some implementations, the pattern or color may be based on a percentage of available parking spaces with respect to a number of total parking spaces in the parking facility.

In some implementations, interface 100 may include a legend to identify parking availability information for a parking facility by color or pattern, identify an entrance location for a parking facility (e.g., as represented by a solid line or a hashed line on interface 100), identify a direction of entrance for a parking facility, and/or identify some other parking related information.

In some implementations, and as shown in interface 100, the parking availability information be oriented parallel to the representation of the entrance (e.g., the solid line). In some implementations, parking availability information for each level of the parking facility may be oriented in order of levels in the parking facility. For example, as shown in interface 100, parking information for level 1 in the parking facility may be oriented adjacent to the solid line representing the parking entrance, followed by parking information for level 2, parking information for level 3, and so on (e.g., such that parking availability may be identified for different levels without needing to read an indication identifying the parking levels).

In some implementations, interface 100 may identify parking availability information in the form of a heat map or some other form. In some implementations, interface 100 may identify a location of a parking sign having information that identifies available parking in the parking facility. While a particular format of interface 100 is shown in FIG. 1, in practice, interface 100 may appear differently and may display parking information in some other format than what is shown in FIG. 1. For example, the particular patterns and/or colors may vary from what is shown in FIG. 1.

Figure 1B:
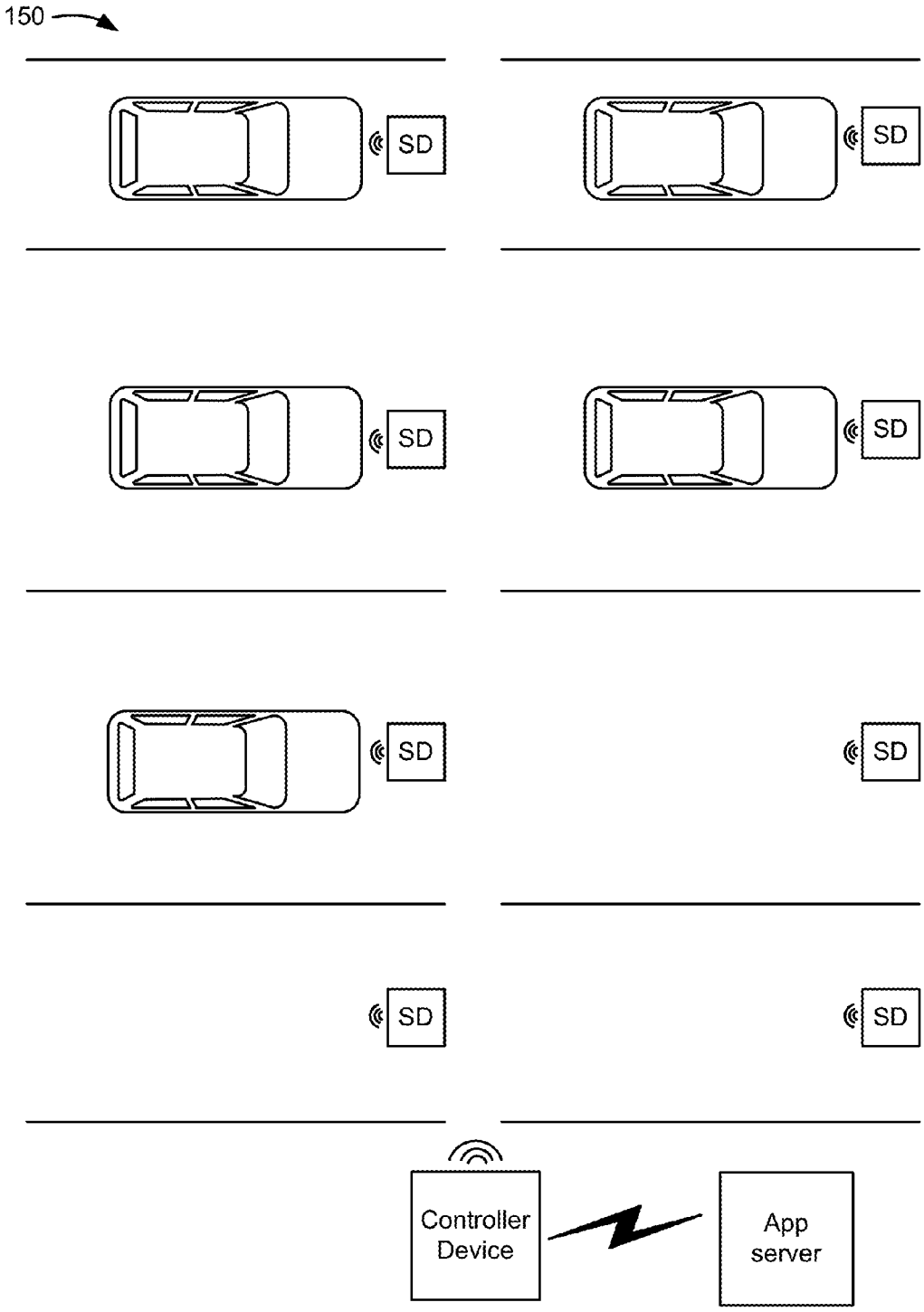

As described above, the app server may receive the parking availability information from a controller device. For example, referring to FIG. 1B, parking facility 150 may include multiple parking spaces, each having a sensor device (SD). In some implementations, the sensor devices may be located in a different location than what is shown in FIG. 1B. In some implementations, a sensor device may communicate with the controller device (e.g., via a wireless or wired network) to identify whether a vehicle is parked in the parking space associated with the sensor device. The controller device may store parking availability information that identifies a total number of parking spaces and a number of available parking spaces (e.g., based on information received by the sensor devices) and may provide the parking availability information to app server, as described above.

As a result, an available parking space can be quickly identified, thereby saving a motorist's time, fuel costs, vehicle wear-and-tear costs, and other costs associated with locating an available parking space. Further, vehicle traffic may be reduced, thereby reducing vehicle emissions and/or reducing manpower for traffic directing efforts, etc.

Figure 2:
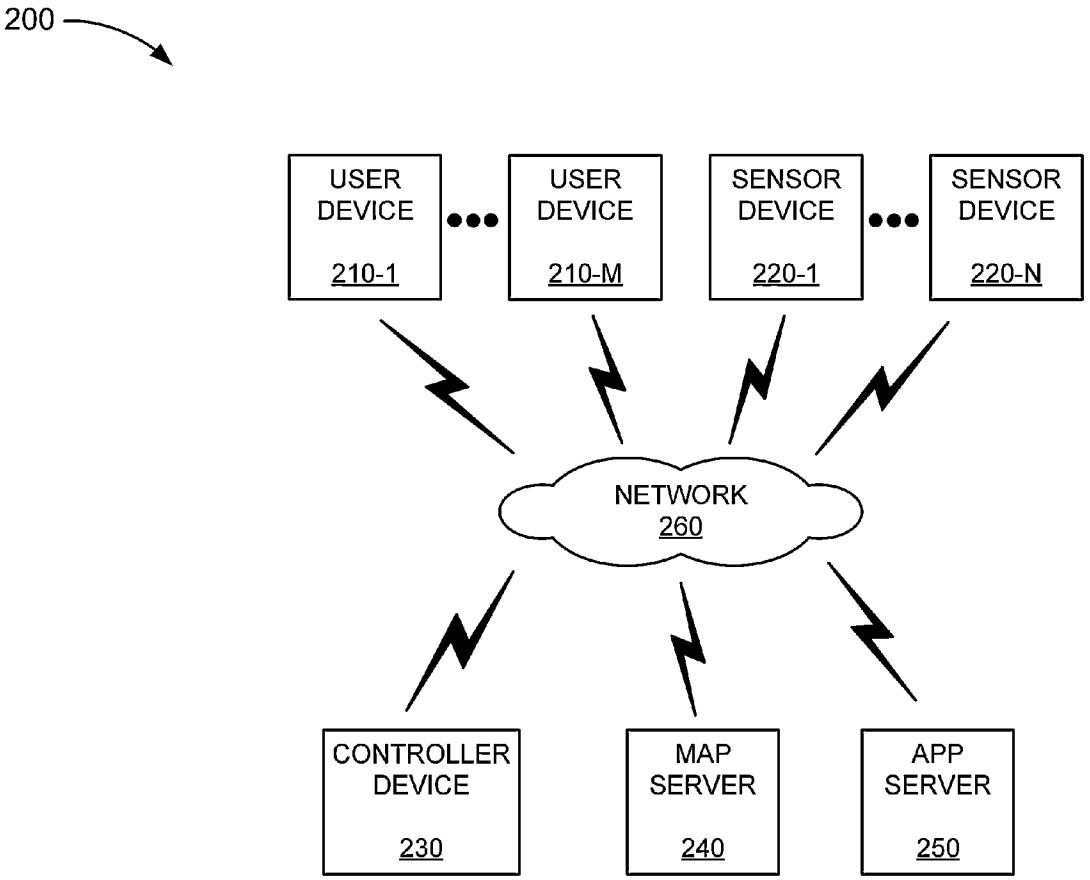
FIG. 2 illustrates an example environment in which systems and/or methods, described herein, may be implemented.

FIG. 2 is a diagram of an example environment 200 in which systems and/or methods described herein may be implemented. As shown in FIG. 2, environment 200 may include user devices 210-1, . . . , 210-M (where M>1), sensor devices 220-1, . . . 220-N (where N>1), controller device 230, map server 240, app server 250, and network 260.

User device 210 may include a device capable of communicating via a network, such as network 260. For example, user device 210 may correspond to a mobile communication device (e.g., a smart phone or a personal digital assistant (PDA)), a portable computer device (e.g., a laptop, a tablet computer, a vehicle navigation device, a wearable computer, etc.), or another type of computing device. In some implementations, user device 210 may communicate with app server 250 to receive parking availability information for display on a user interface of user device 210. In some implementations, user device 210 may receive parking availability information from controller device 230 (e.g., independently of app server 250).

Sensor device 220 may include one or more sensors, such as an object-detecting sensor or some other type of sensor. In some implementations, sensor device 220 may detect the presence of an object (e.g., a vehicle) in a particular field of view of the sensor (e.g., a field of view corresponding to a parking space). For example, sensor device 220 may include a camera device, a weight sensor (e.g., to detect the presence of a vehicle when an object greater than a threshold weight is detected), a sound sensor (e.g., to detect a vehicle-related sound, such as a vehicle engine sound, a sound corresponding to a vehicle door closing, or the like), an exhaust detection sensor, a radar sensor, an oil sticker sensor, or some other type of sensor that can detect the presence of a vehicle.

In some implementations, a particular sensor device 220 may be associated with a particular parking space and may provide an indication, to controller device 230, that a vehicle is parked in the particular parking space. For example, the particular sensor device 220 may be mounted above the particular parking space such that the particular sensor device 220 can detect when a motorist parks a vehicle in the particular parking space. Additionally or alternatively, sensor device 220 may be located in the vehicle and may transmit information to controller device 230 that identifies that the vehicle is parked in a particular parking space. Additionally, or alternatively, sensor device 220 may receive an indication from user device 210 that a vehicle is parked in the particular parking space. For example, user device 210 may send an indication to sensor device 220 when a velocity of user device 210 has dropped from a driving velocity to a walking velocity (e.g., to indicate that a user of user device 210 and associated with the vehicle has parked the vehicle and is now walking). Additionally, or alternatively, sensor device 220 may receive an indication from a parking metering device that indicates that a vehicle is parked in the particular parking space (e.g., when time is remaining on the parking metering device).

Controller device 230 may include one or more computing devices, such as a server device or a collection of server devices. In some implementations, controller device 230 may receive information, from sensor device 220, that identifies available and/or unavailable parking spaces in a particular parking facility associated with controller device 230. In some implementations, controller device 230 may receive parking availability information from multiple sensor devices 220 associated with the same party and/or associated with different parties.

In some implementations, controller device 230 may be located in a parking facility or may be located in some other location. In some implementations, controller device 230 may store parking availability information for one or more parking facilities. In some implementations, controller device 230 may store information identifying layouts for one or more parking facilities and may store information that maps parking availability information to the layouts. In some implementations, controller device 230 may include a display that identifies parking availability information. In some implementations, the display may be located near an entrance of the parking facility and may include a transmitter device to transmit parking availability information and/or some other parking-related data to user device 210 and/or app server 250. Additionally, or alternatively, the display may function as a femto cell to allow user devices 210 to connect a cellular network.

Map server 240 may include one or more computing devices, such as a server device or a collection of server devices. In some implementations, map server 240 may store map data that user device 210 and/or app server 250 may access to display a map on a display of user device 210. In some implementations, map server 240 may store information identifying a geographic location associated with a parking facility. Additionally, map server 240 may store information identifying a layout of the parking facility (e.g., a blueprint, a number of levels, a number of parking spaces, etc.). For example, a party, associated with the parking facility (e.g., a management company, an owner, etc.), may provide the information identifying the layout of the parking facility to map server 240 using a client device and/or via an interface of map server 240 (e.g., a web portal or some other interface). In some implementations, information stored by map server 240 may be updated to reflect a change in the layout of the parking facility (e.g., a change in the number of parking spaces, a change in the location of the parking spaces, a change in the number of levels, and/or some other type of change associated with the parking facility).

App server 250 may include one or more computing devices, such as a server device or a collection of server devices. In some implementations, app server 250 may receive map data (e.g., from map server 240) and/or may receive parking availability information (e.g., from controller device 230). In some implementations, app server 250 may overlay parking availability information onto a map to form combined parking and map data. In some implementations, app server 250 may provide the combined parking and map data to user device 210 such that user device 210 may display the combined parking and map data. An example of a display of the combined parking and map data is described above with respect to interface 100.

Network 260 may include one or more wired and/or wireless networks. For example, network 260 may include a cellular network, a public land mobile network (PLMN), a second generation (2G) network, a third generation (3G) network, a fourth generation (4G) network, a fifth generation (5G) network, and/or another network. Additionally, or alternatively, network 260 may include a local area network (LAN), a wide area network (WAN), a metropolitan network (MAN), a telephone network (e.g., the Public Switched Telephone Network (PSTN)), an ad hoc network, a managed IP network, a virtual private network (VPN), an intranet, the Internet, a fiber optic-based network, and/or a combination of these or other types of networks.

The quantity of devices and/or networks, illustrated in FIG. 2, is not limited to what is shown. In practice, there may be additional devices and/or networks; fewer devices and/or networks; different devices and/or networks; or differently arranged devices and/or networks than illustrated in FIG. 2. Also, in some implementations, one or more of the devices of environment 200 may perform one or more functions described as being performed by another one or more of the devices of environment 200. Devices of environment 200 may interconnect via wired connections, wireless connections, or a combination of wired and wireless connections.

Figure 3:
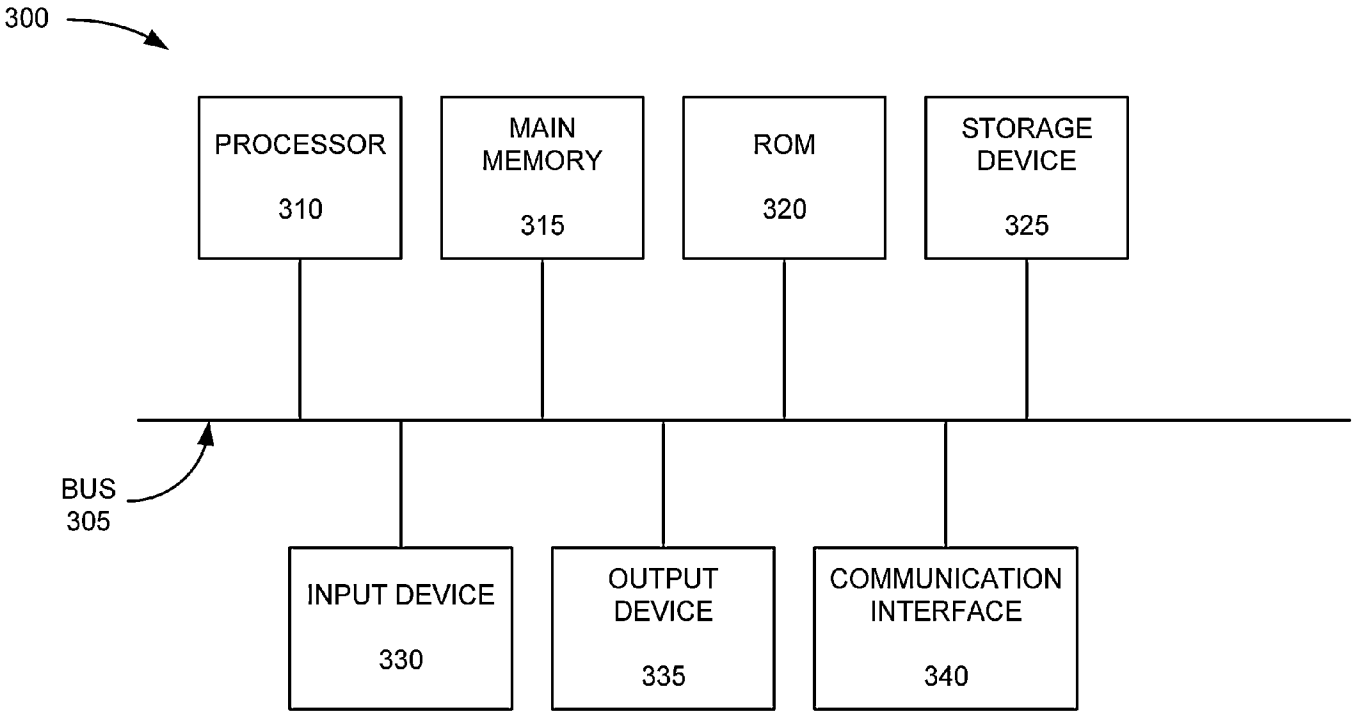
FIG. 3 illustrates example components of a device that may be used within the environment of FIG. 2.

FIG. 3 illustrates example components of a device 300 that may be used within environment 200 of FIG. 2. Device 300 may correspond to user device 210, sensor device 220, controller device 230, map server 240, and/or app server 250. Each of user device 210, sensor device 220, controller device 230, map server 240, and/or app server 250 may include one or more devices 300 and/or one or more components of device 300.

As shown in FIG. 3, device 300 may include a bus 305, a processor 310, a main memory 315, a read only memory (ROM) 320, a storage device 325, an input device 330, an output device 335, and a communication interface 340.

Bus 305 may include a path that permits communication among the components of device 300. Processor 310 may include a processor, a microprocessor, an application specific integrated circuit (ASIC), a field programmable gate array (FPGA), or another type of processor that interprets and executes instructions. Main memory 315 may include a random access memory (RAM) or another type of dynamic storage device that stores information or instructions for execution by processor 310. ROM 320 may include a ROM device or another type of static storage device that stores static information or instructions for use by processor 310. Storage device 325 may include a magnetic storage medium, such as a hard disk drive, or a removable memory, such as a flash memory.

Input device 330 may include a component that permits an operator to input information to device 300, such as a control button, a keyboard, a keypad, or another type of input device. Output device 335 may include a component that outputs information to the operator, such as a light emitting diode (LED), a display, or another type of output device. Communication interface 340 may include any transceiver-like mechanism that enables device 300 to communicate with other devices or networks. In some implementations, communication interface 340 may include a wireless interface, a wired interface, or a combination of a wireless interface and a wired interface.

Device 300 may perform certain operations, as described in detail below. Device 300 may perform these operations in response to processor 310 executing software instructions contained in a computer-readable medium, such as main memory 315. A computer-readable medium may be defined as a non-transitory memory device. A memory device may include memory space within a single physical storage device or memory space spread across multiple physical storage devices.

The software instructions may be read into main memory 315 from another computer-readable medium, such as storage device 325, or from another device via communication interface 340. The software instructions contained in main memory 315 may direct processor 310 to perform processes that will be described later. Alternatively, hardwired circuitry may be used in place of or in combination with software instructions to implement processes described herein. Thus, implementations described herein are not limited to any specific combination of hardware circuitry and software.

In some implementations, device 300 may include additional components, fewer components, different components, or differently arranged components than are shown in FIG. 3.

FIG. 4 illustrates an example data structure 400 that may be stored by one or more devices in environment 200. In some implementations, data structure 400 may be stored in a memory of controller device 230. In some implementations, data structure 400 may be stored in a memory separate from, but accessible by, controller device 230. In some implementations, data structure 400 may be stored by some other device in environment 200, such as user device 210, sensor device 220, map server 240 and/or app server 250.

A particular instance of data structure 400 may contain different information and/or fields than another instance of data structure 400. In some implementations, one instance of data structure 400 may correspond to parking availability information for a particular parking facility. Another instance of data structure 400 may correspond to parking availability information for another particular parking facility. Additionally, or alternatively, data structure 400 may correspond to parking availability information for multiple parking facilities.

As shown in FIG. 4, data structure 400 may include raw sensor data field 410 and summary data field 420.

Raw sensor data field 410 may store information identifying available and unavailable parking spaces for a particular parking facility (e.g., based on information received from sensor device 220). For example, raw sensor data field 410 may store a parking facility identifier (ID) to identify the particular parking facility and/or may store a parking facility location (e.g., a geographic location of the particular parking facility). In some implementations, raw sensor data field 410 may store space IDs to uniquely identify each parking space in the particular parking facility. Additionally, or alternatively, raw sensor data field 410 may store information to identify the type of parking space (e.g., a regular parking space, a parallel parking space, a handicap parking space, etc.). Additionally, or alternatively, raw sensor data field 410 may store information to identify a level that a particular parking space is located (e.g., basement level, lower level, level 1, level 2, roof level, etc.). Additionally, or alternatively, raw sensor data field 410 may store information to identify a parking fee associated with a particular parking space.

Additionally, raw sensor data field 410 may store information to identify whether the particular parking space is unavailable (e.g., occupied, as indicated by an "X" corresponding to a particular parking space ID). In some implementations, the absence of an identifier corresponding to the particular parking space ID may indicate that the particular parking space is available (e.g., not occupied). In some implementations, information stored by raw sensor data field 410 may be based on information provided by sensor device 220. For example, sensor device 220 may provide a value to indicate whether a particular parking space is available or unavailable. For example, a value of zero (0) may indicate that the parking space is available and a value of one (1) may indicate that the parking space is unavailable. Alternatively, a value of one (1) may indicate that the parking space is available and a value of zero (0) may indicate that the parking space is not available. Additionally, or alternatively, some other values may indicate that the parking space is available or unavailable.

Additionally, or alternatively, raw sensor data field 410 may store some other information relating to a parking space, such as an identifier of a particular sensor device 220 associated with the parking space, a parking fee associated with the parking space, and/or a maximum parking time that the motorist may park the vehicle in the parking space. Additionally, or alternatively, raw sensor data field 410 may store information identifying a distance between the parking space and an exit of the parking facility, information identifying a distance between the parking space and an elevator and/or staircase in the parking facility, and/or some other information relating to the parking space.

Summary data field 420 may store information to identify parking availability information by level and parking space type. For example, as shown in FIG. 4, summary data field 420 may store information to identify a number of regular type parking spaces available on a particular level, a number of handicap type parking spaces available on the particular level, a total number of parking spaces available on the particular level, a total number of parking spaces on the particular level, and a percentage of the total number of parking spaces available on the particular level with respect to the total number of parking spaces on the particular level. In some implementations, the percentage may be used to derive a visual representation of parking availability. For example, user device 210 may display a particular color or pattern based on the percentage of parking available.

Additionally, or alternatively, summary data field 420 may store information to identify a number parking spaces within a particular distance of an exit of the parking facility, a number of parking spaces within a particular distance of an elevator or staircase at the parking facility, a number parking spaces having a particular parking fee, and/or a number of parking spaces associated with some other parking related parameter. In some implementations, information stored by summary data field 420 may be based on information stored by raw sensor data field 410.

While particular fields are shown in a particular format in data structure 400, in practice, data structure 400 may include additional fields, fewer fields, different fields, or differently arranged fields than are shown in FIG. 4.

Figure 5:
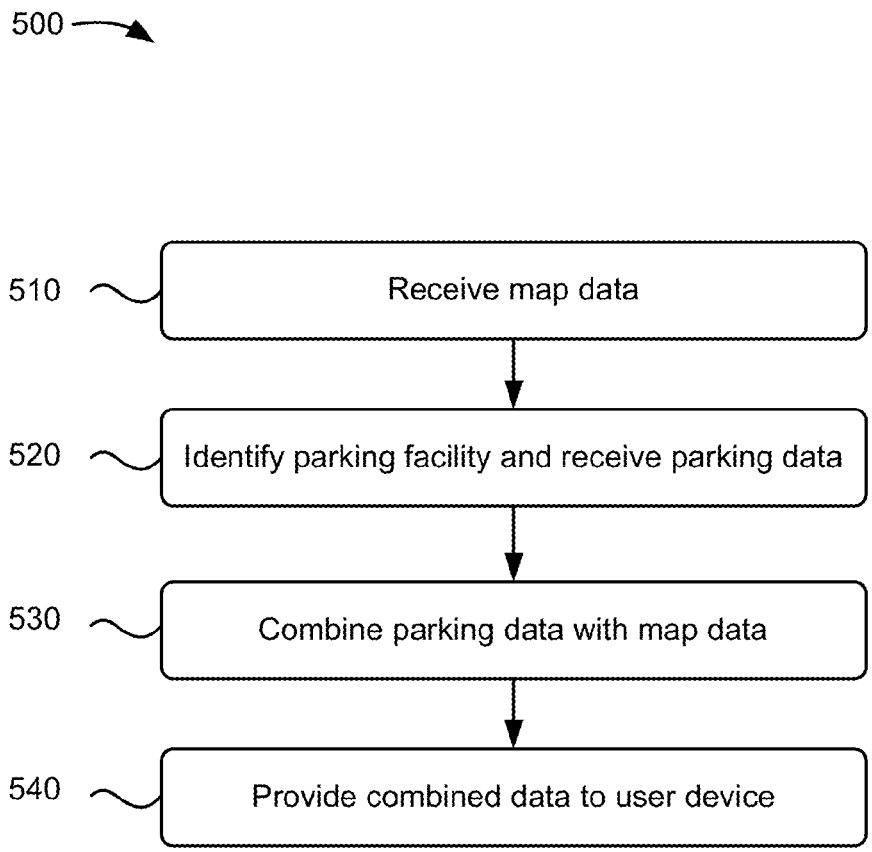
FIG. 5 illustrates a flowchart of an example process for providing parking information to a user device.

FIG. 5 illustrates a flowchart of an example process 500 for providing parking information to user device 210. In one implementation, process 500 may be performed by one or more components of app server 250. In another implementation, some or all of blocks of process 500 may be performed by one or more components of another device in environment 200 (e.g., user device 210, controller device 230 or map server 240), or a group of devices including or excluding app server 250.

As shown in FIG. 5, process 500 may include receiving map data (block 510). For example, app server 250 may receive map data when a user of user device 210 selects an application to identify parking facilities in a particular geographic area. In some implementations, the particular geographic area may be provided by the user of user device 210 (e.g., via user interaction with a user interface to select the area on a map displayed on user device 210). Additionally, or alternatively, the particular geographic area may be based on a current location of user device 210 (e.g., as determined by a global positioning system (GPS) device of user device 210 and/or determined using another technique). In some implementations, app server 250 may receive the map data from map server 240 and/or from some other source.

In some implementations, the map data may include a geographic map (e.g., a road map or some other type of geographic map) corresponding to the particular geographic area. In some implementations, the map data may include information identifying parking facilities within the particular geographic area. Additionally, the map data may include information identifying a layout of a parking facility (e.g., a blueprint of the parking facility, a number of levels in the parking facility, a number of parking spaces in the parking facility, etc.).

Process 500 may further include identifying a parking facility and receiving parking data (block 520). For example, app server 250 may identify a parking facility within the particular geographic area based on the map data. In some implementations, app server 250 may receive parking data from a particular controller device 230 associated with the identified parking facility. For example, app server 250 may query controller device 230 for the parking data. Additionally, or alternatively, controller device 230 may broadcast the parking data in a manner that allows app server 250 to receive the parking data. In some implementations, the parking data may identify an entry location of the parking facility, and/or an indication that identifies available and/or unavailable parking spaces (e.g., a number of available and/or unavailable parking spaces, a pattern and/or color that indicates a number of available and/or unavailable parking spaces, etc.).

Additionally, or alternatively, the parking data may include information that identifies some other information relating to a parking space (e.g., a parking fee associated with the parking space, a size of the parking space, a type of the parking space, a level in which the parking space is located, a distance between the parking space and an elevator and/or staircase located in the parking facility, etc.). In some implementations, the parking data may correspond to information stored by data structure 400.

Process 500 may further include combining the parking data with the map data (block 530). For example, app server 250 may combine the parking data with the map data to form combined data. In some implementations, the combined data may be used to generate a map having the parking data overlaid on a map associated with the map data.

Process 500 may also include providing the combined data to the user device (block 540). For example, app server 250 may provide the combine data to user device 210 to cause user device 210 to display the map having parking data overlaid on the map. An example of a map with the parking data overlaid on the map is described above with respect to interface 100.

While a particular series of blocks has been described above with regard to FIG. 5, the operations, data flows, and/or the order of the blocks may be modified in other implementations. Further, non-dependent operations and/or data flows may be performed in parallel.

Figure 6:
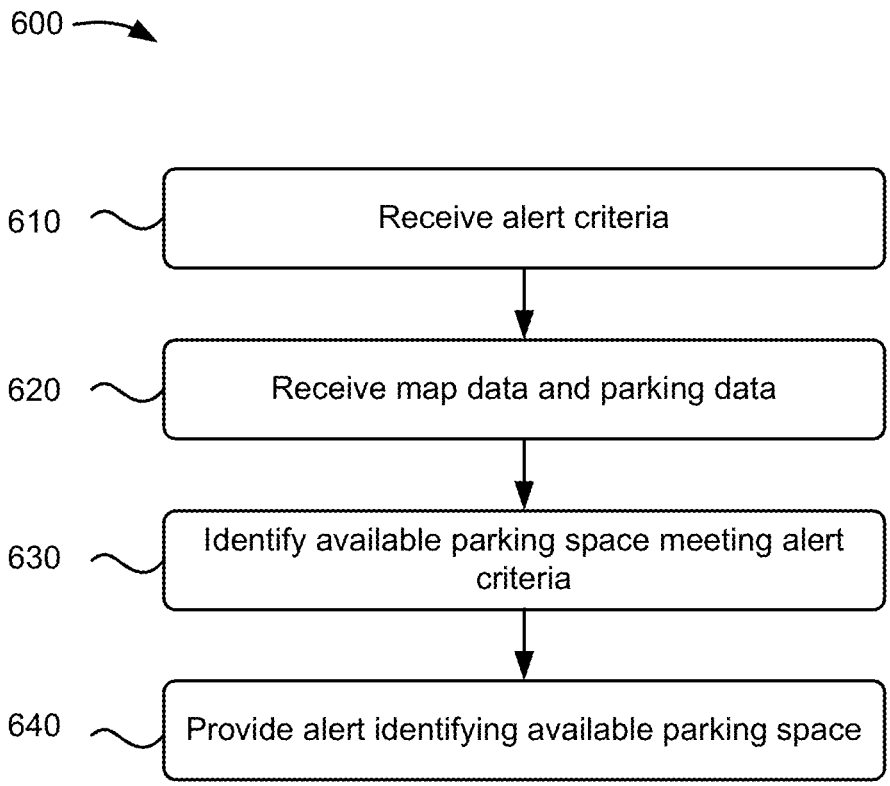
FIG. 6 illustrates a flowchart of an example process for alerting a motorist of an available parking space meeting particular criteria.

FIG. 6 illustrates a flowchart of an example process 600 for alerting a motorist of an available parking space meeting particular criteria. In one implementation, process 600 may be performed by one or more components of user device 210. In another implementation, some or all of blocks of process 600 may be performed by one or more components of another device in environment 200 (e.g., controller device 230, map server 240, or app server 250), or a group of devices including or excluding user device 210.

As shown in FIG. 6, process 600 may include receiving alert criteria (block 610). For example, a user of user device 210 may provide the alert criteria (e.g., via a user interface of user device 210) to direct user device 210 to provide an alert when an available parking space, meeting the alert criteria, is identified. In some implementations, the alert criteria may identify a threshold distance between a location of user device 210 and the parking space, a threshold distance between the parking space and some other location (e.g., a landmark, a point of interest, an elevator in a parking facility associated with the parking space, etc.), a threshold parking fee of the parking space, a particular type of parking space, and/or some other information associated with the parking space. Additionally, or alternatively, an alert criteria may identify a time of day or some other information used to provide an alert.

Process 600 may further include receiving map data and parking data (block 620). For example, user device 210 may receive map data from app server 220, map server 240 and/or from some other source (e.g., from a storage medium, such as a digital video disc (DVD)). In some implementations, the map data may include a map of a particular geographic area identified by a user of user device 210 (e.g., via a user interface of user device 210). In some implementations, user device 210 may identify a parking facility based on the map data and may receive parking data for the parking facility from controller device 230 (e.g., in a similar manner as described above with respect to blocks 510 and 520). Additionally, or alternatively, app server 220 may identify a parking facility based on the map data and may receive parking data for the parking facility from controller device 230 and provide the parking data for the parking facility to user device 210.

Process 600 may also include identifying an available parking space meeting the alert criteria (block 630). For example, user device 210 may identify an available parking space meeting the alert criteria based on the alert criteria, the map data, and/or the parking data. As an example, assume that the alert criteria identify a threshold distance from a particular location and identify a particular parking space type. Further, assume that user device 210 moves to a position within the threshold distance of the particular location. Further, assume that the parking data identifies an available parking space having the particular parking space type. Given these assumptions, user device 210 may identify that the available parking space meets the alert criteria.

Process 600 may further include providing an alert identifying the available parking space (block 640). For example, user device 210 may provide an alert based on identifying the available parking space meeting the alert criteria. In some implementations, user device 210 may display the alert on a display of user device 210. Additionally, or alternatively, user device 210 may display a map identifying the geographic location of the available parking space. In some implementations, the map may display a location of user device 210 and may display directions to the available parking space. Additionally, or alternatively, the map may display the parking data overlaid on the map.

While a particular series of blocks has been described above with regard to FIG. 6, the operations, data flows, and/or the order of the blocks may be modified in other implementations. Further, non-dependent operations and/or data flows may be performed in parallel. In some implementations, app server 250 may perform some or all of process 600. For example, app server 250 may receive alert criteria from user device 210, may receive map data and parking data from map server 240 and/or a storage medium, may identify an available parking space meeting the alert criteria (e.g., by receiving geographic location information associated with user device 210), and/or may provide an alert, to user device 210, identifying the available parking space.

Figure 7:
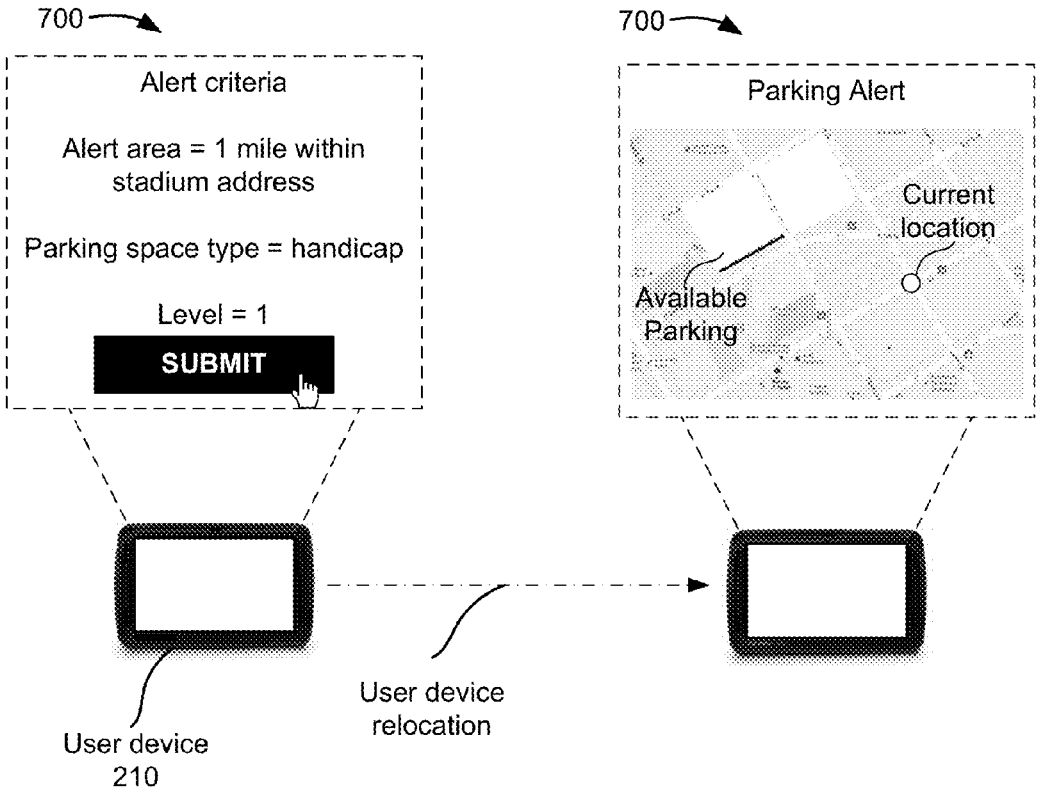
FIGS. 7-8B illustrate example implementations as described herein.

FIG. 7 illustrates an example implementation as described herein. As shown in FIG. 7, a user of user device 210 may provide alert criteria via a user interface of user device 210 (e.g., interface 700). For example, assume that the user provides alert criteria, such as an alert area (e.g., a one-mile radius within a street address of a stadium), a parking space type (e.g., a handicap parking space type), and a level corresponding to where the parking space is located in a parking facility (e.g., level one or ground level). Further, assume that user device 210 relocates to a geographic location that is within a one-mile radius of the street address of the stadium. Further, assume that user device 210 identifies an available parking space meeting the alert criteria provided by the user (e.g., as described above with respect to process 600). Given these assumptions, user device 210 may provide an alert that identifies an available parking space meeting the alert criteria.

Additionally, user device 210 may display a map having information that identifies a location of the available parking space. For example, as described above, user device 210 may display a map having parking data overlaid on the map, as described above (e.g., a color or pattern overlaid on the map that represents available parking) Additionally, or alternatively, user device 210 may display directions to the available parking space. Additionally, or alternatively, user device 210 may display a list of parking facilities having available parking in order of distance between user device 210 and the parking facilities (or in some other order).

While a particular example is shown in FIG. 7, it will be apparent that the above description is merely an example implementation. For example, in practice, interface 700 may appear different and may have a different format that what is shown in FIG. 7. Also, user device 210 may receive any number of criteria not described above, such as a time of day, a threshold distance between a parking space and an exit of a corresponding parking facility, a parking facility type (e.g., a garage, a lot, street parking, etc.), a threshold parking fee, and/or some other criteria.

Figure 8A:
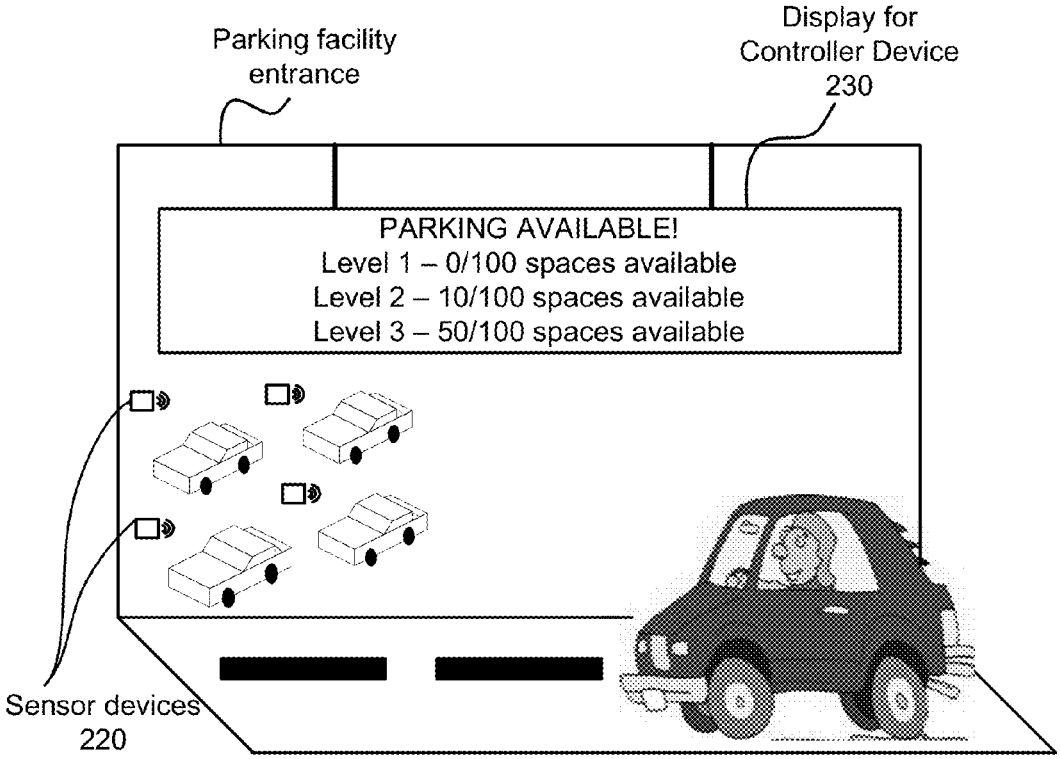
Figure 8B:
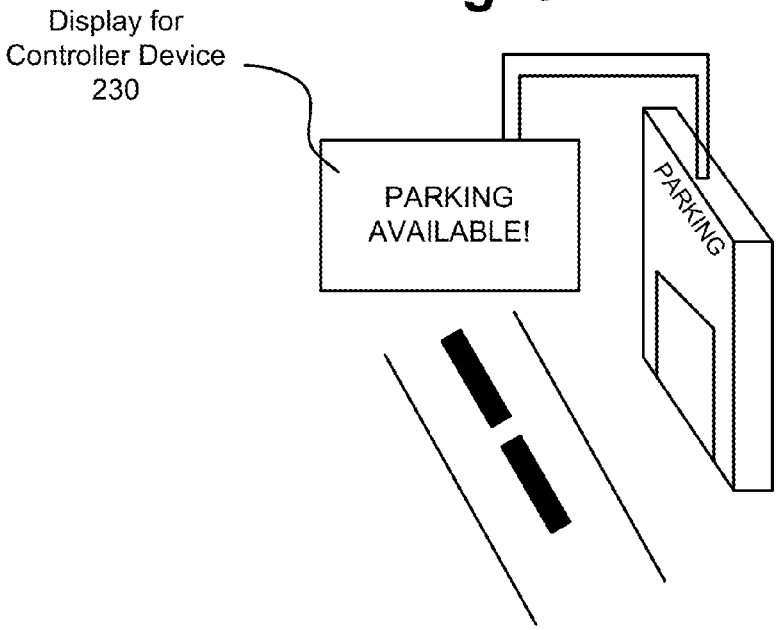

FIGS. 8A-8B illustrate example implementations as described herein. In FIGS. 8A-8B, assume that controller device 230 is implemented in a parking facility. For example, controller device 230 may communicate with sensor devices 220 to receive parking data that identifies available and/or unavailable parking spaces in the parking facility. As shown in FIG. 8A, controller device 230 may include a display that identifies available parking spaces based on information received by sensor devices 220.

In some implementations, the display may be located at an entrance of the parking facility and may be visible to allow a motorist to view the display prior to entering the parking facility (e.g., such that the motorist may enter the parking facility when parking is available in the parking facility). For example, as shown in FIG. 8A, the display of controller device 230 may be oriented substantially parallel to a direction of travel of the motorist. Referring to FIG. 8B, the display of controller device 230 may be oriented substantially perpendicular to a direction of travel such that the motorist may view parking availability as the motorist approaches the parking facility. As a result of information being displayed on the display of controller device 230, the motorist may identify parking availability without viewing user device 210.

In some implementations, the display may be located in some other location the parking facility, for example, at an intersection such that a motorist may identify directions to an available parking space in the parking facility. In some implementations, the display may output a color corresponding to available parking such that a motorist may quickly identify available parking. For example, the display may output the color red to indicate that the parking facility does not have available parking such that the motorist may modify course in order to find another facility having available parking.

In some implementations, the motorist may identify available parking and a particular level (or particular portion) of the parking facility having available parking based on information provided by the display. Thus, a motorist may travel to the particular level and bypass other levels or other portions of the parking facility that does not have available parking, thereby reducing time in finding an available parking space.

In some implementations, a motorist may use user device 210 to check in to a particular parking space. For example, the motorist may use user device 210 to communicate with a particular sensor device 220 that is associated with the particular parking space. In some implementations, controller device 230 may store information that identifies that a particular user device 210 has checked in to a particular parking space (e.g., based on information provided by sensor device 220).

In some implementations, user device 210 may store the location of the particular parking space such that the motorist may identify the location of the particular parking space (e.g., when the motorist returns to the parking space at a later time). In some implementations, the motorist may communicate with controller device 230 to make a payment for parking in the particular parking space for a period of time (e.g., a period of time corresponding to a parking time limit). In some implementations, sensor device 220 may detect when a vehicle has left the particular parking space and communicate this information to controller device 230. In some implementations, a law enforcement agency may receive information that identifies when a time limit has expired or that a payment for a parking space has not been made. For example, controller device 230 may store information that identifies that a vehicle has parked in a space without making a required payment. Additionally, or alternatively, controller device 230 may store information that identifies a time when a payment is made for parking and a time when the time limit has expired and the vehicle has not been removed from the parking space.

As described above, an available parking space can be quickly identified, thereby saving a motorist's time, fuel costs, vehicle wear-and-tear costs, and other costs associated with locating an available parking space. Further, vehicle traffic may be reduced by reducing the number of vehicles circling a block while motorists look for an available parking space, thereby reducing vehicle emissions and/or reducing manpower for traffic directing efforts, etc.

The foregoing description provides illustration and description, but is not intended to be exhaustive or to limit the possible implementations to the precise form disclosed. Modifications and variations are possible in light of the above disclosure or may be acquired from practice of the implementations.

It will be apparent that different examples of the description provided above may be implemented in many different forms of software, firmware, and hardware in the implementations illustrated in the figures. The actual software code or specialized control hardware used to implement these examples is not limiting of the implementations. Thus, the operation and behavior of these examples were described without reference to the specific software code—it being understood that software and control hardware can be designed to implement these examples based on the description herein.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

No element, act, or instruction used in the present application should be construed as critical or essential unless explicitly described as such. Also, as used herein, the article "a" is intended to include one or more items and may be used interchangeably with "one or more." Where only one item is intended, the term "one" or similar language is used. Further, the phrase "based on" is intended to mean "based, at least in part, on" unless explicitly stated otherwise.

What is claimed is:

1. A method comprising:

receiving, by a device, a user-submitted alert criterion,
- the user-submitted alert criterion including information identifying:
  - a particular geographic area,
  - information associated with a particular parking space location, and
  - information associated with a particular type of parking space;

receiving, by the device and based on the user-submitted alert criterion, map data that identifies a parking facility located in the particular geographic area;

identifying, by the device, the parking facility based on the map data;

receiving, by the device, parking data that identifies an available parking space located in the parking facility or an unavailable parking space located in the parking facility,
- the parking data being based on information associated with at least one of:
  - a quantity of parking spaces within a particular distance from a particular structure, or
  - a quantity of parking spaces associated with a particular parking fee;

combining, by the device, the map data and the parking data to form combined data; and providing, by the device, the combined data for display,
- the combined data permitting a map of the particular geographic area to be displayed,
  - the map including information associated with the parking facility and information associated with a quantity of available parking spaces in the parking facility or a quantity of unavailable parking spaces in the parking facility.

2. The method of claim 1, where the map data is received from a server device or a storage medium.

3. The method of claim 1, where the parking data is received from one or more sensors, and when receiving the parking data, the method includes:
- receiving the parking data based on receiving the parking data from the one or more sensors.

4. The method of claim 1, further comprising:

providing the parking data for presentation on a display,
- the display being visible from an exterior of the parking facility.

5. The method of claim 1, further comprising:

identifying, based on the parking data, an available parking space that satisfies the user-submitted alert criterion; and providing, based on identifying the available parking space that satisfies the user-submitted alert criterion, an alert for display.

6. The method of claim 1, where the user-submitted alert criterion identifies at least one of:

a parking space type, a time of day, a parking fee, or a threshold distance from a particular geographic location.

7. A system comprising:

a device to:

receive a user-submitted alert criterion,
- the user-submitted alert criterion including information identifying:
  - a particular geographic area,
  - information associated with a particular parking space location, and
  - information associated with a particular type of parking space;

receive, based on the user-submitted alert criterion, map data that identifies a parking facility located in the particular geographic area;

identify the parking facility based on the map data;

receive parking data that identifies an available parking space located in the parking facility or an unavailable parking space located in the parking facility, the parking data being generated based on data received from one or more sensors implemented in the parking facility, and the parking data being based on information associated with at least one of:

a quantity of parking spaces within a particular distance from a particular structure, or a quantity of parking spaces associated with a particular parking fee;

combine the map data and the parking data to form combined data; and provide the combined data for display, the combined data permitting a map of the particular geographic area to be displayed, the map including information associated with the parking facility and information associated with a quantity of available parking spaces in the parking facility or a quantity of unavailable parking spaces in the parking facility.

8. The system of claim 7, where, when receiving the map data, the device is to:

receive the map data from a server device or a storage medium.

9. The system of claim 7, where the device is further to:

provide the parking data for presentation on a display, the display being visible from an exterior of the parking facility.

10. The system of claim 7, where the device is further to:

identify, based on the parking data, an available parking space that satisfies the user-submitted alert criterion; and provide, based on identifying the available parking space that satisfies the user-submitted alert criterion, an alert for display.

11. The system of claim 10, where the user-submitted alert criterion identifies at least one of:

a parking space type, a time of day, a parking fee, or a threshold distance from a particular geographic location.

12. A non-transitory computer-readable medium for storing instructions, the instructions comprising:

a plurality of instructions which, when executed by one or more processors associated with a device, cause the one or more processors to:

receive a user-submitted alert criterion, the user-submitted alert criterion including information identifying:

a particular geographic area, information associated with a particular parking space location, and information associated with a particular type of parking space;

receive, based on the user-submitted alert criterion, map data that identifies a parking facility located in the particular geographic area;

identify the parking facility based on the map data;

receive parking data that identifies an available parking space located in the parking facility or an unavailable parking space located in the parking facility, the parking data being based on information associated with at least one of:

a quantity of parking spaces within a particular distance from a particular structure, or a quantity of parking spaces associated with a particular parking fee;

combine the map data and the parking data to form combined data; and provide the combined data for display, the combined data permitting a map of the particular geographic area to be displayed, the map including information associated with the parking facility and information associated with a quantity of available parking spaces in the parking facility or a quantity of unavailable parking spaces in the parking facility.

13. The non-transitory computer-readable medium of claim 12, where the plurality of instructions further cause the one or more processors to:

provide the parking data for presentation on a display, the display being visible from an exterior of the parking facility.

14. The non-transitory computer-readable medium of claim 12, where the plurality of instructions further cause the one or more processors to:

identify, based on the parking data, an available parking space that satisfies the user-submitted alert criterion; and provide, based on identifying the available parking space that satisfies the user-submitted alert criterion, an alert for display.

15. The non-transitory computer-readable medium of claim 14, where the user-submitted alert criterion identifies at least one of:

a parking space type, a parking fee, a time of day, or a threshold distance from a particular geographic location.

16. A system comprising:

a user device to:

receive a user-submitted alert criterion to identify an available parking space in a parking facility located in a particular geographic area, the user-submitted alert criterion including information identifying:

the particular geographic area, information associated with a particular parking space location, and information associated with a particular type of parking space;

receive, based on the user-submitted alert criterion, map data that identifies the parking facility located in the particular geographic area;

identify the parking facility based on the map data;

receive parking data that identifies the available parking space or an unavailable parking space located in the parking facility, the parking data being based on information associated with at least one of:

a quantity of parking spaces within a particular distance from a particular structure, or a quantity of parking spaces associated with a particular parking fee;

combine the map data and the parking data to form combined data;

provide the combined data for display on the user device;

identify an available parking space meeting the alert criterion based on the parking data;

provide an alert for display based on identifying the available parking space meeting the alert criterion; and display the combined data and the alert, the combined data and the alert permitting the user device to display a map of the particular geographic area, the map including information associated with the parking facility and information associated with a quantity of available parking spaces in the parking facility or a quantity of unavailable parking spaces in the parking facility.

17. The system of claim 16, where the map includes a representation of an entrance associated with the parking facility.

18. The system of claim 16, where, when receiving the map data, the user device is to:

receive the map data from a server device or a storage medium.

19. The system of claim 16, where the criterion identifies at least one of:

a parking space type, a time of day, a parking fee, or a threshold distance from a particular geographic location.

20. The system of claim 16, where, when receiving the parking data, the user device is further to:

receive the parking data from one or more sensors implemented in the parking facility.

* * * * *